US010716444B2

(12) United States Patent
Khalil et al.

(10) Patent No.: US 10,716,444 B2
(45) **Date of Patent: *Jul. 21, 2020**

(54) VACUUM CLEANER HAVING CYCLONIC SEPARATOR

(71) Applicant: Techtronic Industries Co. Ltd., Tsuen Wan, New Territories (HK)

(72) Inventors: David Khalil, College Park, MD (US); Christopher M. Charlton, Medina, OH (US); Justin C. Andrikanich, Stow, OH (US); David Chaney, Sagamore Hills, OH (US); William Nabors, Copley, OH (US)

(73) Assignee: Techtronic Industries Co. Ltd., Tsuen Wan, New Territories (HK)

( * ) Notice: Subject to any disclaimer, the term of this patent is extended or adjusted under 35 U.S.C. 154(b) by 37 days.

This patent is subject to a terminal disclaimer.

(21) Appl. No.: 15/610,721

(22) Filed: Jun. 1, 2017

(65) Prior Publication Data

US 2017/0265700 A1 Sep. 21, 2017

Related U.S. Application Data

(63) Continuation of application No. 14/920,166, filed on Oct. 22, 2015, now Pat. No. 9,693,665.
(Continued)

(51) Int. Cl.
*A47L 9/16* (2006.01)

(52) U.S. Cl.
CPC ..... *A47L 9/1608* (2013.01); *A47L 9/165* (2013.01); *A47L 9/1658* (2013.01); *A47L 9/1683* (2013.01); *A47L 9/1691* (2013.01)

(58) Field of Classification Search
CPC .... A47L 7/0038; A47L 7/0028; A47L 7/0042; A47L 9/1683; A47L 9/1666;
(Continued)

(56) References Cited

U.S. PATENT DOCUMENTS 2,657,417 A 11/1953 Howard
4,268,288 A 5/1981 Coombs
(Continued)

FOREIGN PATENT DOCUMENTS

EP 1690487 8/2006
GB 2438489 11/2007
(Continued)

OTHER PUBLICATIONS

International Search Report and Written Opinion for Application No. PCT/US2015/056918 dated Apr. 20, 2016 (17 pages).

*Primary Examiner* — Robert J Scruggs
(74) *Attorney, Agent, or Firm* — Michael Best & Friedrich LLP

(57) ABSTRACT

A vacuum cleaner including a debris separator that includes a housing, a cyclonic separator including a cylindrical wall having a first end and a second end. The cylindrical wall is located in within the housing and the cyclonic separator further includes a dirty air inlet, a clean air outlet, a debris outlet adjacent the second end, and a longitudinal axis surrounded by the cylindrical wall and the longitudinal axis of the cyclonic separator extends in generally a horizontal orientation. The debris separator further includes a lid coupled to the housing and the cyclonic separator is coupled to the lid such that the cyclonic separator is removable from the housing with the lid. A debris collection chamber is located within the housing and in fluid communication with the debris outlet of the cyclonic separator.

26 Claims, 10 Drawing Sheets

Related U.S. Application Data

(60) Provisional application No. 62/067,284, filed on Oct. 22, 2014.

(58) Field of Classification Search
CPC ..... A47L 9/1608; A47L 9/165; A47L 9/1658; A47L 9/1691; A47L 9/16
See application file for complete search history.

(56) References Cited

U.S. PATENT DOCUMENTS 4,403,372 A 9/1983 Keane et al.
4,789,476 A 12/1988 Schulz
4,853,008 A 8/1989 Dyson
5,350,432 A 9/1994 Lee
5,779,744 A * 7/1998 Mueller ..... A47L 7/0028 15/350
5,779,745 A 7/1998 Kilstrom
5,935,279 A 8/1999 Kilstrom
5,950,274 A 9/1999 Kilstrom
6,003,196 A 12/1999 Wright et al.
6,129,775 A 10/2000 Conrad et al.
6,141,826 A 11/2000 Conrad et al.
6,168,641 B1 1/2001 Tuvin et al.
6,168,716 B1 1/2001 Conrad et al.
6,173,474 B1 1/2001 Conrad
6,195,835 B1 3/2001 Song et al.
6,221,134 B1 4/2001 Conrad et al.
6,228,151 B1 5/2001 Conrad et al.
6,228,260 B1 5/2001 Conrad et al.
6,231,645 B1 5/2001 Conrad et al.
6,251,296 B1 6/2001 Conrad et al.
6,277,278 B1 8/2001 Conrad et al.
6,306,199 B1 10/2001 Gustafson et al.
6,312,594 B1 11/2001 Conrad et al.
6,334,234 B1 1/2002 Conrad et al.
6,344,064 B1 2/2002 Conrad
6,350,292 B1 2/2002 Lee et al.
6,391,095 B1 5/2002 Conrad et al.
6,398,834 B2 6/2002 Oh
6,406,505 B1 6/2002 Oh et al.
6,419,719 B2 7/2002 Conrad et al.
6,432,154 B2 8/2002 Oh et al.
6,440,197 B1 8/2002 Conrad et al.
6,482,246 B1 11/2002 Dyson et al.
6,485,536 B1 11/2002 Masters
6,502,277 B1 * 1/2003 Petersson ..... A47L 9/102 15/352
6,502,278 B2 1/2003 Oh et al.
6,519,804 B1 2/2003 Vujik
6,532,620 B2 3/2003 Oh
6,533,834 B2 3/2003 Conrad et al.
6,536,073 B2 3/2003 Uratani et al.
6,546,593 B2 4/2003 Oh et al.
6,553,612 B1 4/2003 Dyson et al.
6,558,453 B2 5/2003 Sepke et al.
6,562,093 B2 5/2003 Oh
6,572,668 B1 6/2003 An et al.
6,578,230 B2 6/2003 Park et al.
6,579,334 B2 6/2003 Oh et al.
6,582,489 B2 6/2003 Conrad
6,588,051 B2 7/2003 Hashizume et al.
6,589,309 B2 7/2003 Oh et al.
6,596,045 B2 7/2003 Qian
6,596,046 B2 7/2003 Conrad et al.
6,596,047 B2 7/2003 Oh
6,599,338 B2 7/2003 Oh et al.
6,599,339 B2 7/2003 Oh
6,599,340 B2 7/2003 Conrad et al.
6,607,572 B2 8/2003 Gammack et al.
6,607,575 B2 8/2003 Oh et al.
6,613,116 B2 9/2003 Oh
6,613,129 B2 9/2003 Gen
6,616,721 B2 9/2003 Oh
6,623,539 B2 9/2003 Lee et al.
6,625,845 B2 9/2003 Matsumoto et al.
6,640,385 B2 11/2003 Oh et al.
6,648,934 B2 11/2003 Choi et al.
6,660,053 B2 12/2003 Oh et al.
6,662,403 B2 12/2003 Oh
6,679,930 B1 1/2004 An et al.
6,702,868 B2 3/2004 Oh et al.
6,706,095 B2 3/2004 Morgan
6,709,495 B1 3/2004 Storer
6,712,868 B2 3/2004 Murphy et al.
6,732,405 B2 5/2004 Oh
6,732,406 B2 5/2004 Oh
6,735,816 B2 5/2004 Oh et al.
6,736,873 B2 5/2004 Conrad et al.
6,746,500 B1 6/2004 Park et al.
6,757,933 B2 7/2004 Oh et al.
6,766,557 B2 7/2004 Park et al.
6,766,558 B1 7/2004 Matsumoto et al.
6,782,583 B2 8/2004 Oh
6,782,585 B1 8/2004 Conrad et al.
6,810,557 B2 11/2004 Hansen et al.
6,810,558 B2 11/2004 Lee
6,811,584 B2 11/2004 Oh
6,818,033 B2 11/2004 North
6,818,036 B1 11/2004 Seaman
6,824,580 B2 11/2004 Oh
6,833,015 B2 12/2004 Oh et al.
6,835,222 B2 12/2004 Gammack
6,840,972 B1 1/2005 Kim
6,857,165 B2 2/2005 Oh
6,868,578 B1 3/2005 Kasper et al.
6,874,197 B1 4/2005 Conrad et al.
6,896,711 B2 5/2005 Oh
6,901,626 B2 6/2005 Bair et al.
6,902,596 B2 6/2005 Conrad et al.
6,916,351 B2 7/2005 Oh
6,925,680 B2 8/2005 Oh
6,928,692 B2 8/2005 Oh et al.
6,948,212 B2 9/2005 Oh et al.
6,951,045 B2 10/2005 Thur et al.
6,968,596 B2 11/2005 Oh et al.
6,974,488 B2 12/2005 Dyson
6,977,003 B2 12/2005 Lim et al.
6,989,039 B2 1/2006 Vujik
6,991,666 B2 1/2006 Organ
6,994,740 B2 2/2006 Gammack et al.
7,014,671 B2 3/2006 Oh
7,022,154 B2 4/2006 Oh
7,065,826 B1 6/2006 Arnold
7,074,248 B2 7/2006 Jin et al.
7,086,119 B2 8/2006 Go et al.
7,097,680 B2 8/2006 Oh
7,105,034 B2 9/2006 Jung et al.
7,105,035 B2 9/2006 Oh et al.
7,114,216 B2 10/2006 Stephens et al.
7,128,770 B2 10/2006 Oh et al.
7,140,068 B1 11/2006 Vander Baan et al.
7,152,276 B2 12/2006 Jin et al.
7,152,277 B2 12/2006 Jung et al.
7,160,346 B2 1/2007 Park
7,162,770 B2 1/2007 Davidshofer
7,163,568 B2 1/2007 Sepke et al.
7,169,201 B2 1/2007 Oh et al.
7,171,725 B2 2/2007 Sjoberg et al.
7,188,388 B2 3/2007 Best et al.
7,210,192 B2 5/2007 Ito et al.
7,228,592 B2 6/2007 Hawkins et al.
7,247,181 B2 7/2007 Hansen et al.
7,261,754 B2 8/2007 Oh et al.
7,273,506 B2 9/2007 Oh et al.
7,276,099 B2 10/2007 Hayashi et al.
7,288,129 B2 10/2007 Oh et al.
7,291,190 B2 11/2007 Dummelow
7,291,193 B2 11/2007 Oh et al.
7,293,326 B2 11/2007 Hawkins et al.
7,294,159 B2 11/2007 Oh et al.
7,297,172 B2 11/2007 Lee
7,309,368 B2 12/2007 Oh et al.
7,326,268 B2 2/2008 Oh et al.

(56) References Cited

U.S. PATENT DOCUMENTS

| | | | |
|---|---|---|---|
| 7,329,295 | B2 | 2/2008 | Greene et al. |
| 7,331,084 | B2 | 2/2008 | Oh |
| 7,332,008 | B2 | 2/2008 | Oh et al. |
| 7,334,290 | B2 | 2/2008 | Hawkins et al. |
| 7,335,241 | B2 | 2/2008 | Oh et al. |
| 7,335,242 | B2 | 2/2008 | Oh |
| 7,341,611 | B2 | 3/2008 | Greene et al. |
| 7,343,643 | B2 | 3/2008 | Kondo |
| 7,354,468 | B2 | 4/2008 | Arnold et al. |
| 7,361,200 | B2 | 4/2008 | Oh et al. |
| 7,377,007 | B2 | 5/2008 | Best |
| 7,377,953 | B2 | 5/2008 | Oh |
| 7,381,233 | B2 | 6/2008 | Oh et al. |
| 7,381,234 | B2 | 6/2008 | Oh |
| 7,381,236 | B2 | 6/2008 | Lee et al. |
| 7,381,247 | B2 | 6/2008 | Han et al. |
| 7,381,248 | B2 | 6/2008 | Kim et al. |
| 7,395,579 | B2 | 7/2008 | Oh |
| 7,398,578 | B2 | 7/2008 | Lee |
| 7,404,231 | B2 | 7/2008 | Kang |
| 7,407,524 | B2 | 8/2008 | Han et al. |
| 7,409,744 | B2 | 8/2008 | Go et al. |
| 7,410,517 | B2 | 8/2008 | Han et al. |
| 7,410,535 | B2 | 8/2008 | Song et al. |
| 7,416,575 | B2 | 8/2008 | Oh et al. |
| 7,419,521 | B2 | 9/2008 | Oh et al. |
| 7,419,522 | B2 | 9/2008 | Arnold |
| 7,419,523 | B2 | 9/2008 | Sjoberg et al. |
| 7,422,614 | B2 | 9/2008 | Sepke et al. |
| 7,422,615 | B2 | 9/2008 | Kim |
| 7,429,284 | B2 | 9/2008 | Oh et al. |
| 7,438,737 | B2 | 10/2008 | Song et al. |
| 7,448,146 | B2 | 11/2008 | Cho et al. |
| 7,449,039 | B2 | 11/2008 | Hong et al. |
| 7,449,040 | B2 | 11/2008 | Conrad et al. |
| 7,455,708 | B2 | 11/2008 | Conrad et al. |
| 7,462,212 | B2 | 12/2008 | Han et al. |
| 7,470,299 | B2 | 12/2008 | Han et al. |
| 7,473,289 | B2 | 1/2009 | Oh et al. |
| 7,475,449 | B2 | 1/2009 | Lee |
| 7,479,172 | B2 | 1/2009 | Ivarsson |
| 7,479,173 | B2 | 1/2009 | Ivarsson et al. |
| 7,481,860 | B2 | 1/2009 | Ivarsson |
| 7,485,164 | B2 | 2/2009 | Jeong et al. |
| 7,491,255 | B2 | 2/2009 | Jung |
| 7,494,523 | B2 | 2/2009 | Oh et al. |
| 7,497,899 | B2 | 3/2009 | Han et al. |
| 7,501,002 | B2 | 3/2009 | Han et al. |
| 7,513,924 | B2 | 4/2009 | French et al. |
| 7,534,279 | B2 | 5/2009 | Oh et al. |
| 7,537,625 | B2 | 5/2009 | Han et al. |
| 7,544,224 | B2 | 6/2009 | Tanner et al. |
| 7,544,226 | B2 | 6/2009 | Oh |
| 7,547,336 | B2 | 6/2009 | Fester et al. |
| 7,547,337 | B2 | 6/2009 | Oh et al. |
| 7,547,338 | B2 | 6/2009 | Kim et al. |
| 7,547,351 | B2 | 6/2009 | Oh et al. |
| 7,555,808 | B2 | 7/2009 | Oh et al. |
| 7,556,661 | B2 | 7/2009 | Jeong et al. |
| 7,556,662 | B2 | 7/2009 | Lee et al. |
| 7,559,963 | B2 | 7/2009 | Oh et al. |
| 7,559,964 | B2 | 7/2009 | Oh et al. |
| 7,559,965 | B2 | 7/2009 | Oh et al. |
| 7,563,296 | B2 | 7/2009 | Ni |
| 7,563,297 | B2 | 7/2009 | Kim |
| 7,563,298 | B2 | 7/2009 | Oh |
| 7,565,853 | B2 | 7/2009 | Arnold et al. |
| 7,582,128 | B2 | 9/2009 | Hwang et al. |
| 7,582,129 | B2 | 9/2009 | Kim et al. |
| 7,594,943 | B2 | 9/2009 | Oh et al. |
| 7,594,944 | B2 | 9/2009 | Oh |
| 7,594,945 | B2 | 9/2009 | Kim et al. |
| 7,597,730 | B2 | 10/2009 | Yoo et al. |
| 7,604,674 | B2 | 10/2009 | Han et al. |
| 7,604,675 | B2 | 10/2009 | Makarov et al. |
| 7,611,558 | B2 | 11/2009 | Oh et al. |
| 7,615,089 | B2 | 11/2009 | Oh |
| 7,618,470 | B2 | 11/2009 | Eddington et al. |
| 7,628,831 | B2 | 12/2009 | Gomiciaga-Pereda et al. |
| 7,628,832 | B2 | 12/2009 | Sepke et al. |
| 7,628,833 | B2 | 12/2009 | Oh |
| 7,632,324 | B2 | 12/2009 | Makarov et al. |
| 7,632,327 | B2 | 12/2009 | Yoo |
| 7,635,400 | B2 | 12/2009 | Yoo |
| 7,637,973 | B2 | 12/2009 | Oh et al. |
| 7,637,991 | B2 | 12/2009 | Eddington et al. |
| 7,645,311 | B2 | 1/2010 | Oh et al. |
| 7,651,544 | B1 | 1/2010 | Fester et al. |
| 7,662,201 | B2 | 2/2010 | Lee |
| 7,662,202 | B2 | 2/2010 | Oh et al. |
| 7,678,166 | B2 | 3/2010 | Yoo et al. |
| 7,682,412 | B2 | 3/2010 | Oh |
| 7,686,858 | B2 | 3/2010 | Oh |
| 7,686,861 | B2 | 3/2010 | Oh |
| 7,691,161 | B2 | 4/2010 | Oh et al. |
| 7,704,290 | B2 | 4/2010 | Oh |
| 7,708,789 | B2 | 5/2010 | Fester |
| 7,708,791 | B2 | 5/2010 | Oh et al. |
| 7,708,808 | B1 | 5/2010 | Heumann |
| 7,717,973 | B2 | 5/2010 | Oh et al. |
| 7,722,693 | B2 | 5/2010 | Yoo et al. |
| 7,731,770 | B2 | 6/2010 | Strutt et al. |
| 7,740,675 | B2 | 6/2010 | Conrad |
| 7,743,461 | B2 | 6/2010 | Carr et al. |
| 7,744,667 | B2 | 6/2010 | Oh et al. |
| 7,744,668 | B2 | 6/2010 | Oh et al. |
| 7,748,079 | B2 | 7/2010 | McDowell et al. |
| 7,749,293 | B2 | 7/2010 | Conrad |
| 7,749,296 | B2 | 7/2010 | Han et al. |
| 7,763,090 | B2 | 7/2010 | Gomiciaga-Pereda et al. |
| 7,770,256 | B1 | 8/2010 | Fester |
| 7,771,499 | B2 | 8/2010 | Oh et al. |
| 7,776,115 | B2 | 8/2010 | Oh et al. |
| 7,776,116 | B2 | 8/2010 | Oh et al. |
| 7,776,120 | B2 | 8/2010 | Conrad |
| 7,776,121 | B2 | 8/2010 | Yun et al. |
| 7,780,752 | B2 | 8/2010 | Cha et al. |
| 7,785,381 | B2 | 8/2010 | Oh et al. |
| 7,785,383 | B2 | 8/2010 | Oh et al. |
| 7,789,922 | B1 | 9/2010 | Wai |
| 7,789,923 | B2 | 9/2010 | Oh et al. |
| 7,794,515 | B2 | 9/2010 | Oh et al. |
| 7,803,205 | B2 | 9/2010 | Oh et al. |
| 7,803,207 | B2 | 9/2010 | Conrad |
| 7,806,950 | B2 | 10/2010 | Han et al. |
| 7,811,345 | B2 | 10/2010 | Conrad |
| 7,811,349 | B2 | 10/2010 | Nguyen |
| 7,819,933 | B2 | 10/2010 | Moon et al. |
| 7,828,866 | B2 | 11/2010 | Courtney et al. |
| 7,841,477 | B2 | 11/2010 | Hansen |
| 7,854,779 | B2 | 12/2010 | Oh |
| 7,854,782 | B2 | 12/2010 | Oh et al. |
| 7,862,637 | B2 | 1/2011 | Han et al. |
| 7,867,306 | B2 | 1/2011 | Courtney et al. |
| 7,867,307 | B2 | 1/2011 | Bates et al. |
| 7,867,308 | B2 | 1/2011 | Conrad |
| 7,874,040 | B2 | 1/2011 | Follows et al. |
| 7,879,120 | B2 | 2/2011 | Seo et al. |
| 7,879,121 | B2 | 2/2011 | Oh |
| 7,879,142 | B2 | 2/2011 | Han et al. |
| 7,882,592 | B2 | 2/2011 | Hwang et al. |
| 7,882,593 | B2 | 2/2011 | Beskow et al. |
| 7,887,612 | B2 | 2/2011 | Conrad |
| 7,887,613 | B2 | 2/2011 | Ruben |
| 7,907,680 | B2 | 3/2011 | Tsai et al. |
| 7,908,706 | B2 | 3/2011 | Hawkins et al. |
| 7,914,609 | B2 | 3/2011 | Sullivan et al. |
| 7,918,909 | B2 | 4/2011 | McDowell |
| 7,922,794 | B2 | 4/2011 | Morphey |
| 7,931,717 | B2 | 4/2011 | Conrad |
| 7,931,722 | B2 | 4/2011 | Sepke et al. |
| 7,938,872 | B2 | 5/2011 | Blossey et al. |
| 7,941,895 | B2 | 5/2011 | Conrad |
| 7,951,216 | B2 | 5/2011 | Ha et al. |

(56) References Cited

U.S. PATENT DOCUMENTS 7,951,218 B2 5/2011 Oh
7,966,692 B2 6/2011 Kim
7,967,884 B2 6/2011 Sepke et al.
7,981,181 B2 7/2011 Yoo
7,992,252 B2 8/2011 Park et al.
7,996,956 B2 8/2011 Wood et al.
7,996,957 B2 8/2011 Kah, Jr.
7,998,260 B2 8/2011 Ni
8,015,659 B2 9/2011 Conrad et al.
8,020,707 B2 9/2011 Kim et al.
8,021,453 B2 9/2011 Howes
8,034,140 B2 10/2011 Conrad
8,048,180 B2 11/2011 Oh et al.
8,048,183 B2 11/2011 Conrad
8,062,398 B2 11/2011 Luo et al.
8,097,057 B2 1/2012 Arnold
8,100,999 B2 1/2012 Ashbee et al.
8,146,201 B2 4/2012 Conrad
8,151,407 B2 4/2012 Conrad
8,152,877 B2 4/2012 Greene
8,152,878 B2 4/2012 McLeod
8,152,883 B2 4/2012 Lee
8,161,597 B2 4/2012 Witter et al.
8,161,599 B2 4/2012 Griffith et al.
8,167,964 B2 5/2012 Wai
8,176,597 B2 5/2012 Stein et al.
8,182,563 B2 5/2012 Horne et al.
8,186,006 B2 5/2012 Hyun et al.
8,192,515 B2 6/2012 Conrad
8,209,815 B2 7/2012 Makarov et al.
8,250,702 B2 8/2012 Conrad
8,252,096 B2 8/2012 Horne
8,268,029 B2 9/2012 Yoo
8,282,697 B2 10/2012 Oh
8,292,979 B2 10/2012 Conrad
8,302,252 B2 11/2012 Hyun et al.
8,302,253 B2 11/2012 Ni
8,316,507 B2 11/2012 Hyun et al.
8,348,605 B2 1/2013 de Broqueville
8,349,428 B2 1/2013 Conrad
8,361,179 B2 1/2013 Guerry et al.
8,375,509 B2 2/2013 Bates et al.
8,409,335 B2 4/2013 Dyson et al.
8,419,835 B2 4/2013 Krishnamurthy et al.
8,425,642 B2 4/2013 Worker et al.
8,448,291 B2 5/2013 Conrad
8,448,292 B2 5/2013 Miefalk et al.
8,479,358 B2 7/2013 Conrad
8,484,799 B2 7/2013 Conrad
8,486,170 B2 7/2013 Conrad et al.
8,495,789 B2 7/2013 Nicolaou et al.
8,499,411 B2 8/2013 Tran et al.
8,510,907 B2 8/2013 Conrad
8,528,160 B2 9/2013 Conrad
8,528,163 B2 9/2013 Park et al.
8,528,164 B2 9/2013 Conrad
8,533,903 B2 9/2013 Muhlenkamp et al.
8,533,904 B2 9/2013 Conrad
8,561,257 B2 10/2013 Conrad
8,562,705 B2 10/2013 Courtney et al.
8,567,005 B2 10/2013 Conrad
8,567,006 B2 10/2013 Conrad
8,567,008 B2 10/2013 Conrad
8,568,500 B2 10/2013 Han et al.
8,572,789 B2 11/2013 Horne
8,578,550 B2 11/2013 Conrad
8,578,553 B2 11/2013 Conrad
8,578,555 B2 11/2013 Conrad
8,590,102 B2 11/2013 Conrad
8,601,641 B2 12/2013 Conrad
8,607,406 B2 12/2013 Miefalk et al.
8,607,407 B2 12/2013 Conrad
8,613,125 B2 12/2013 Jeong et al.
8,621,709 B2 1/2014 Conrad
8,631,538 B2 1/2014 Huffman
8,640,303 B2 2/2014 Conrad
8,640,304 B2 2/2014 Conrad
8,646,146 B2 2/2014 Conrad
8,646,147 B2 2/2014 Conrad
8,646,148 B2 2/2014 Sunderland et al.
8,646,149 B2 2/2014 Conrad
8,646,849 B2 2/2014 Crawford et al.
8,657,903 B2 2/2014 Menssen
8,659,184 B2 2/2014 Conrad
8,661,607 B2 3/2014 Hwang et al.
8,661,611 B2 3/2014 Oh
8,667,640 B2 3/2014 Conrad
8,677,554 B2 3/2014 Conrad
8,677,558 B2 3/2014 Conrad
8,683,644 B2 4/2014 Conrad
8,689,395 B2 4/2014 Conrad
8,689,401 B2 4/2014 Makarov et al.
8,695,157 B2 4/2014 Beskow et al.
8,713,751 B2 5/2014 Conrad
8,713,754 B2 5/2014 Conrad
8,739,357 B2 6/2014 Conrad
8,739,359 B2 6/2014 Conrad
8,752,239 B2 6/2014 Conrad
8,763,202 B2 7/2014 Conrad
8,769,767 B2 7/2014 Conrad
8,776,309 B2 7/2014 Conrad
9,693,665 B2 * 7/2017 Khalil ..... A47L 9/165
2002/0011050 A1 1/2002 Hansen et al.
2002/0133901 A1 * 9/2002 Ohta ..... A47L 9/1472 15/347
2002/0134059 A1 9/2002 Oh
2003/0159235 A1 8/2003 Oh
2003/0159411 A1 8/2003 Hansen et al.
2003/0200734 A1 10/2003 Conrad
2004/0098827 A1 5/2004 Oh
2004/0098828 A1 5/2004 Oh
2004/0107530 A1 6/2004 Lee
2004/0163206 A1 8/2004 Oh
2004/0194250 A1 10/2004 Conrad et al.
2004/0231093 A1 11/2004 Oh
2005/0066469 A1 3/2005 Oh et al.
2005/0125940 A1 6/2005 McDowell
2005/0177974 A1 8/2005 Conrad et al.
2005/0198769 A1 9/2005 Lee et al.
2005/0262658 A1 12/2005 Conrad et al.
2006/0075727 A1 4/2006 Kim et al.
2006/0102005 A1 5/2006 Oh
2006/0117721 A1 6/2006 Lee
2006/0117723 A1 6/2006 Yoo
2006/0130265 A1 6/2006 Oh et al.
2006/0130447 A1 6/2006 Seo et al.
2006/0130448 A1 6/2006 Han et al.
2006/0130449 A1 6/2006 Han
2006/0137310 A1 6/2006 Conrad et al.
2006/0230722 A1 10/2006 Oh et al.
2006/0254226 A1 11/2006 Jeon
2006/0272299 A1 12/2006 Choi
2006/0288671 A1 12/2006 Oh et al.
2007/0039292 A1 2/2007 Oh
2007/0079584 A1 4/2007 Kim
2007/0079586 A1 4/2007 Kim
2007/0084159 A1 4/2007 Oh et al.
2007/0084160 A1 4/2007 Kim
2007/0119129 A1 5/2007 Jeon
2007/0144116 A1 6/2007 Hong et al.
2007/0175185 A1 8/2007 Kim et al.
2007/0209334 A1 9/2007 Conrad
2007/0214754 A1 9/2007 Kim
2007/0234687 A1 10/2007 Ni
2007/0234691 A1 10/2007 Han et al.
2008/0196194 A1 8/2008 Conrad
2008/0263813 A1 10/2008 Han et al.
2008/0263815 A1 10/2008 Oh
2008/0264014 A1 10/2008 Oh et al.
2008/0289139 A1 11/2008 Makarov et al.
2008/0289140 A1 11/2008 Courtney et al.
2008/0289306 A1 11/2008 Han et al.
2009/0144932 A1 6/2009 Yoo
2009/0193613 A1 8/2009 Ruben et al.

(56) References Cited

U.S. PATENT DOCUMENTS

2009/0205161 A1 8/2009 Conrad
2009/0229071 A1 9/2009 Fester et al.
2009/0229074 A1 9/2009 Oh
2009/0235482 A1 9/2009 Tanner et al.
2009/0300871 A1 12/2009 Seo et al.
2009/0305862 A1* 12/2009 Yoo ..... A47L 9/1608 494/36
2009/0313958 A1 12/2009 Gomiciaga-Pereda et al.
2010/0043170 A1 2/2010 Ni
2010/0115727 A1 5/2010 Oh
2010/0162517 A1 7/2010 Han et al.
2010/0175217 A1 7/2010 Conrad
2010/0192776 A1 8/2010 Oh et al.
2010/0223752 A1 9/2010 Conrad
2010/0229323 A1 9/2010 Conrad
2010/0229325 A1 9/2010 Conrad
2010/0229330 A1 9/2010 Park et al.
2010/0229334 A1 9/2010 Conrad
2010/0251506 A1 10/2010 Conrad
2010/0269289 A1 10/2010 Ruben
2010/0299865 A1 12/2010 Conrad
2010/0299866 A1 12/2010 Conrad
2011/0146024 A1 6/2011 Conrad
2011/0214247 A1 9/2011 Stephens et al.
2011/0219572 A1* 9/2011 Conrad ..... A47L 9/1658 15/347
2011/0219576 A1 9/2011 Conrad
2011/0240526 A1 10/2011 Tammera et al.
2011/0289720 A1 12/2011 Han et al.
2011/0296648 A1 12/2011 Kah, Jr.
2011/0314631 A1 12/2011 Conrad
2012/0047682 A1 3/2012 Makarov et al.
2012/0117753 A1 5/2012 Kim et al.
2012/0210537 A1* 8/2012 Makarov ..... A47L 9/1608 15/353
2012/0216368 A1 8/2012 Maeda et al.
2012/0222232 A1 9/2012 Conrad
2012/0222238 A1 9/2012 Conrad
2012/0222240 A1 9/2012 Conrad
2012/0222243 A1 9/2012 Conrad
2012/0222247 A1 9/2012 Conrad
2012/0222248 A1 9/2012 Conrad
2012/0222251 A1* 9/2012 Conrad ..... A47L 9/0018 15/347
2012/0222252 A1 9/2012 Conrad
2012/0222253 A1 9/2012 Conrad
2012/0222255 A1 9/2012 Conrad
2012/0222257 A1 9/2012 Conrad
2012/0222258 A1 9/2012 Conrad
2012/0222262 A1 12/2012 Conrad
2012/0311814 A1 12/2012 Kah, Jr.
2013/0008140 A1 1/2013 Pike et al.
2013/0134087 A1 5/2013 Porter et al.
2013/0145575 A1 6/2013 Conrad
2013/0185893 A1 7/2013 Conrad
2014/0013538 A1 1/2014 Dyson et al.
2014/0020203 A1 1/2014 Miefalk et al.
2014/0026356 A1 1/2014 Miefalk et al.
2014/0053367 A1 2/2014 Conrad
2014/0059797 A1 3/2014 Kim et al.
2014/0059799 A1 3/2014 Kim et al.
2014/0215751 A1 8/2014 Kasper et al.

FOREIGN PATENT DOCUMENTS

JP 2004033661 2/2004
WO WO2010044541 4/2010

* cited by examiner

VACUUM CLEANER HAVING CYCLONIC SEPARATOR

CROSS-REFERENCE TO RELATED APPLICATIONS

This application is a continuation of co-pending U.S. patent application Ser. No. 14/920,166, filed on Oct. 22, 2015, which claims priority to U.S. Provisional Patent Application No. 62/067,284, filed on Oct. 22, 2014, the contents of which are hereby incorporated by reference in their entirety.

BACKGROUND

The present invention relates to vacuum cleaners, particularly cyclonic vacuum cleaners.

SUMMARY

In one embodiment, the invention provides a vacuum cleaner including a suction nozzle and a suction source operable to generate an airflow through the vacuum cleaner from the suction nozzle through a debris separator to a clean air exhaust. The debris separator operable to separate debris from the airflow. The debris separator including a housing, a cyclonic separator including a cylindrical wall having a first end and a second end. The cylindrical wall is located in within the housing and the cyclonic separator further includes a dirty air inlet, a clean air outlet, a debris outlet adjacent the second end, and a longitudinal axis surrounded by the cylindrical wall and the longitudinal axis of the cyclonic separator extends in generally a horizontal orientation. The debris separator further includes a lid coupled to the housing and the cyclonic separator is coupled to the lid such that the cyclonic separator is removable from the housing with the lid. A debris collection chamber is located within the housing and in fluid communication with the debris outlet of the cyclonic separator.

In another embodiment, the invention provides a vacuum cleaner including a suction nozzle and a suction source operable to generate an airflow through the vacuum cleaner from the suction nozzle through a debris separator to a clean air exhaust. The debris separator is operable to separate debris from the airflow. The debris separator includes a housing and a cyclonic separator including a cylindrical wall having a first end and a second end. The cylindrical wall is located in within the housing and the cyclonic separator further includes a first end wall located at the first end of the cylindrical wall, an dirty air inlet, a clean air outlet that extends through the first end wall, a debris outlet adjacent the second end, a longitudinal axis surrounded by the cylindrical wall and the longitudinal axis of the cyclonic separator extends in generally a horizontal orientation. A debris collection chamber is located within the housing and in fluid communication with the debris outlet of the cyclonic separator. The housing forms a second end wall of the cyclonic separator located at the second end of the cylindrical wall.

In another embodiment, the invention provides a vacuum cleaner including a suction nozzle and a suction source operable to generate an airflow through the vacuum cleaner from the suction nozzle through a debris separator to a clean air exhaust. The debris separator is operable to separate debris from the airflow. The debris separator includes a housing having a sidewall, a cyclonic separator including a cylindrical wall having a first end and a second end, the cylindrical wall located in within the housing. The cyclonic separator further includes a dirty air inlet, a clean air outlet, a debris outlet adjacent the second end, and a longitudinal axis surrounded by the cylindrical wall and the longitudinal axis of the cyclonic separator extends in generally a horizontal orientation. The debris separator further includes a lid coupled to the housing and the cyclonic separator is coupled to the lid. A debris collection chamber is located within the housing and in fluid communication with the debris outlet of the cyclonic separator. A divider wall extends from the cylindrical wall of the cyclonic separator to the sidewall of the housing such that the sidewall of the housing and the divider wall define the debris collection chamber.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
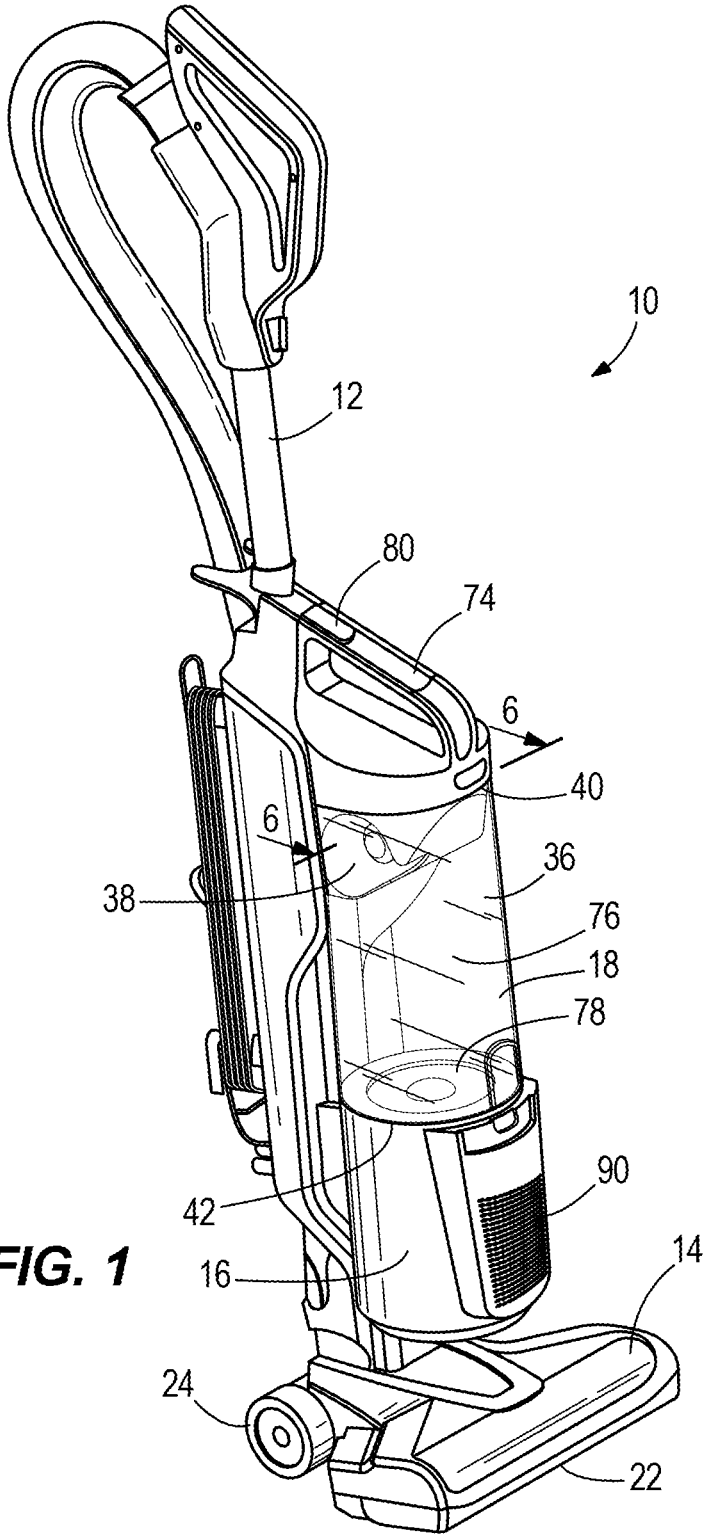
FIG. 1 is a perspective view of a vacuum cleaner according to one embodiment of the invention.

FIG. 1 illustrates a vacuum cleaner 10 accordingly to one embodiment. The illustrated vacuum cleaner 10 includes a handle 12, a base 14, a suction source 16, and a debris separator 18. The handle 12 is pivotally coupled to the base 14 and the handle 12 extends in generally a vertical orientation or upwardly from the base 14. The base 14 includes a suction nozzle 22 and wheels 24 that facilitate movement of the base 14 along a surface being cleaned. Although the illustrated embodiment is an upright vacuum cleaner, alternative embodiments may include canister vacuum cleaners, stick vacuum cleaners, handheld vacuum cleaners, etc.

Figure 5:
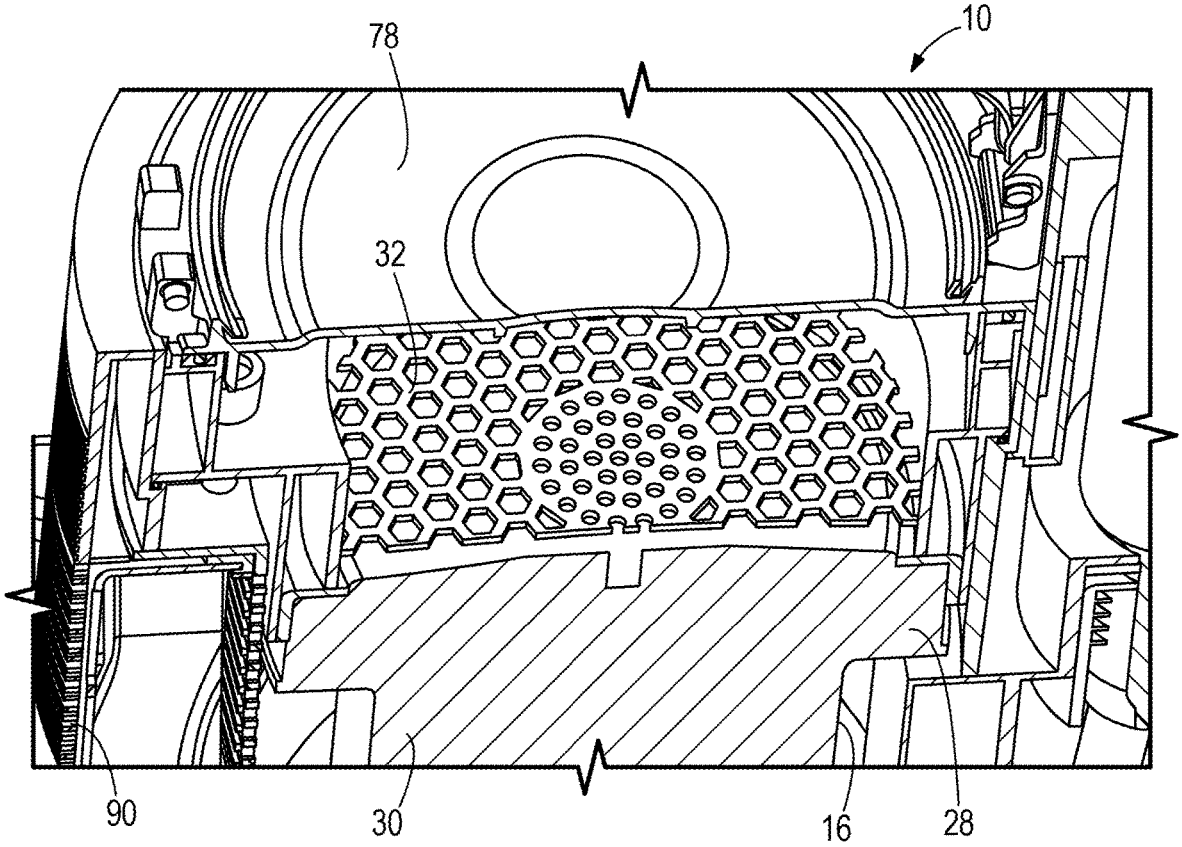
FIG. 5 is a cross-sectional view of a portion of the vacuum cleaner of FIG. 1 taken along lines 5-5 shown in FIG. 4.

Referring to FIG. 5, the suction source 16 includes a fan 28 and a motor 30 that rotates the fan 28 to generate an airflow through the vacuum cleaner 10 that is drawn from the suction nozzle 22 through the debris separator 18 to a clean air exhaust 90. A suction source inlet chamber 32 is located between a clean air outlet of a cyclonic separator of the debris separator 18 and the suction source 16. A premotor filter can be located in the chamber 32 to filter the airflow from the debris separator 18 before traveling through the suction source 16.

Figure 6:
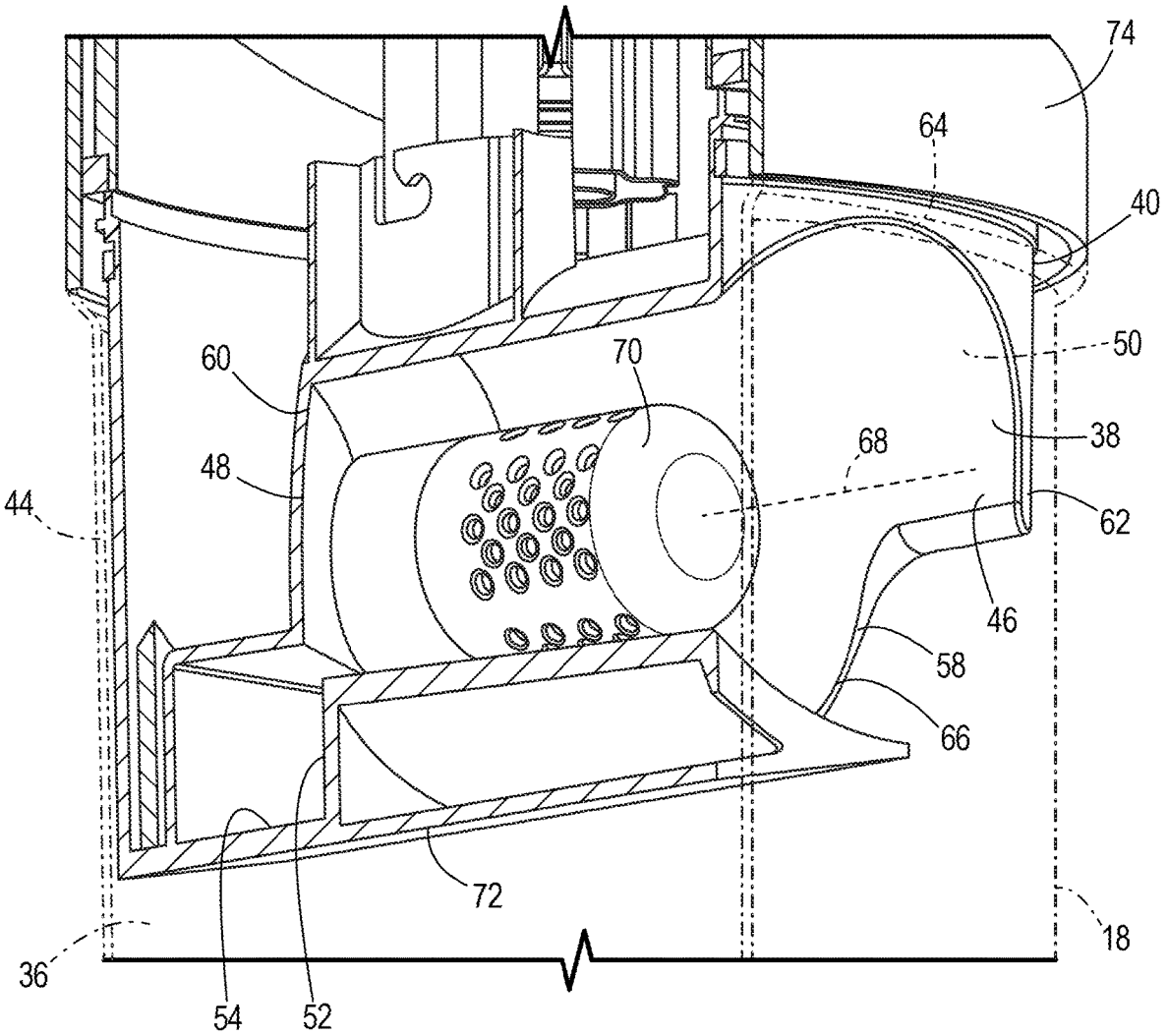
FIG. 6 is a cross-sectional view of the debris separator of the vacuum cleaner of FIG. 1 taken along lines 6-6 shown in FIG. 1.
Figure 7:
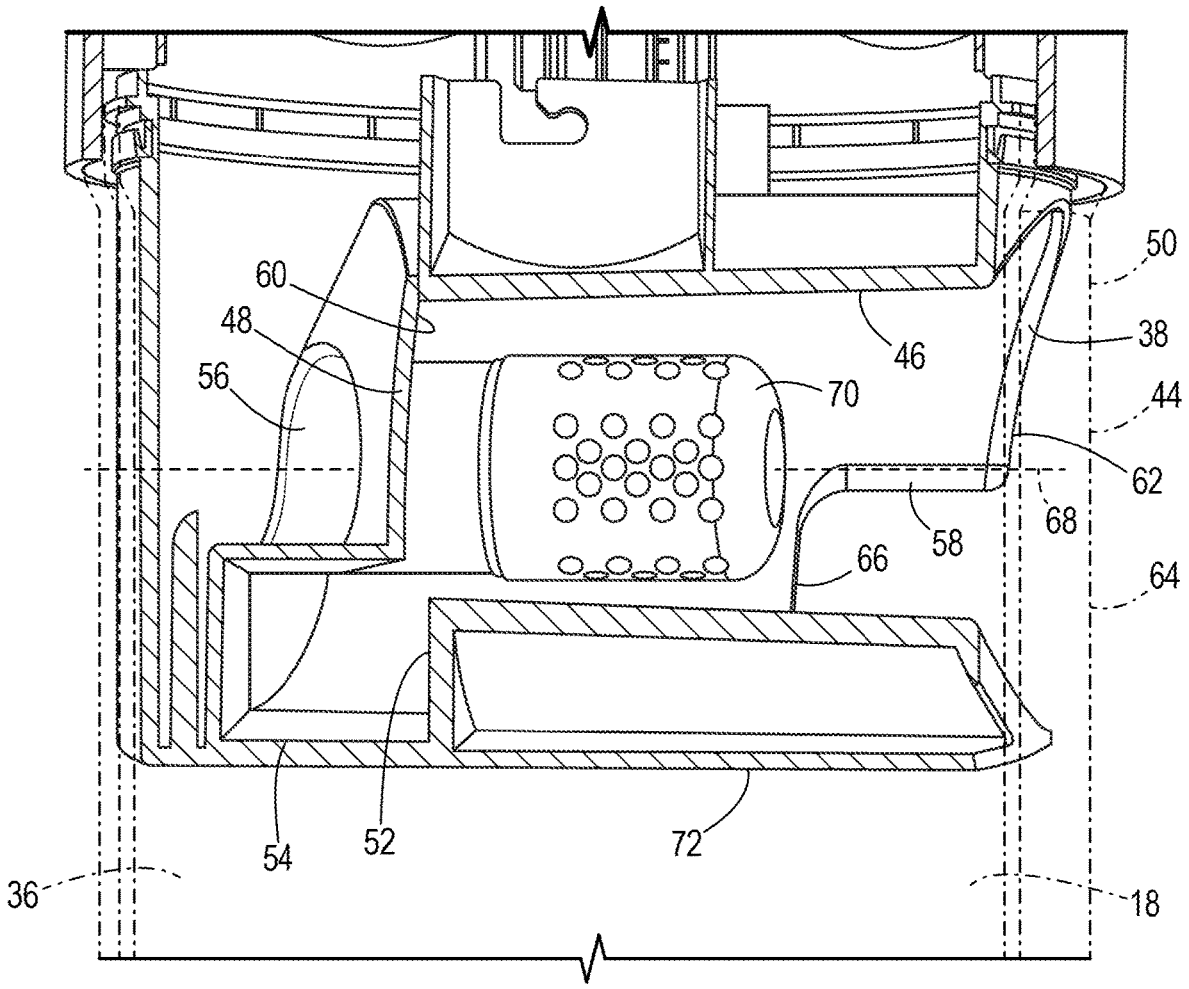
FIG. 7 is a cross-sectional view of the debris separator of the vacuum cleaner of FIG. 1 taken along lines 6-6 shown in FIG. 1.

Referring to FIGS. 6 and 7, the debris separator 18 includes a housing 36 and a cyclonic separator 38 located within the housing 36. The housing 36 includes an upper end 40, a lower end 42 (FIG. 1), and a sidewall 44 that extends between the upper and lower ends 40, 42. In the illustrated embodiment, the sidewall 44 is generally cylindrical.

With reference to FIGS. 1, 2, 6, and 7, the cyclonic separator 38 includes a cylindrical wall 46, a first end wall 48, a second end wall 50, a dirty air inlet 52, a dirty air inlet duct 54, a clean air outlet 56, and a debris outlet 58. The cylindrical wall 46 includes a first end 60 and a second end 62. The dirty air inlet 52 is adjacent the first end 60 of the wall 46 and the debris outlet 58 is adjacent the second end 62 of the cylindrical wall 46. The first end wall 48 is located at the first end 60 of the cylindrical wall 46 and the dirty air inlet 52 extends through the first end wall 48. The second end wall 50 is located at the second end 62 of the cylindrical wall 46. As shown in the illustrated embodiment, the second end wall 50 is formed by a portion 64 of the sidewall 44 of the housing 36. The debris outlet 58 is adjacent the second end 62 of the wall 46 and between the wall 46 and the second end wall 50 that is formed by the portion 64 of the housing 36. In the illustrated embodiment, the wall 46 includes a notch 66 that partially defines the outlet 58. The cyclonic separator 38 further includes a longitudinal axis 68 (FIGS. 6 and 7) that is along or surrounded by the cylindrical wall 46 and the axis 68 is centrally located within the wall 46. The cyclonic separator 38 is orientated such that the axis 68 extends in a generally horizontal orientation. As used in the present description and claims, a generally horizontal orientation means an orientation that is tilted over such that it is not vertical or upright. The generally horizontal orientation includes in various embodiments that are approximately parallel to the ground or floor, as well as orientations that are not parallel to the ground or floor but being generally more laying over than upright, i.e. being tilted more than about 45 degrees.

The debris separator 18 further includes a perforated tube 70, a divider wall 72, a lid 74, a debris collection chamber 76, and a door 78. The perforated tube 70 extends from the first end wall 48 of the cyclonic separator 38 and covers the clean air outlet 56. The perforated tube 70 may be perforated using holes, slots, screen, mesh, or other perforation. The divider wall 72 extends from the cylindrical wall 46 to the sidewall 44 of the housing 36 around the inner periphery of the sidewall 44 such that the sidewall 44 of the housing 36 and the divider wall 72 define the debris collection chamber 76. The debris collection chamber 76 is bounded by and generally located below the divider wall 72 such that air does not circulate around the outside diameter of the cyclone. The divider wall may include a portion extending along the inner periphery toward the lid encircling at least a portion of the cylindrical wall. In the illustrated embodiment, the divider wall 72 is integrally formed with the cylindrical wall 46 as a single component. Also, with reference to FIGS. 6 and 7, the illustrated divider wall 72 partially forms the dirty air inlet duct 54.

Figure 9:
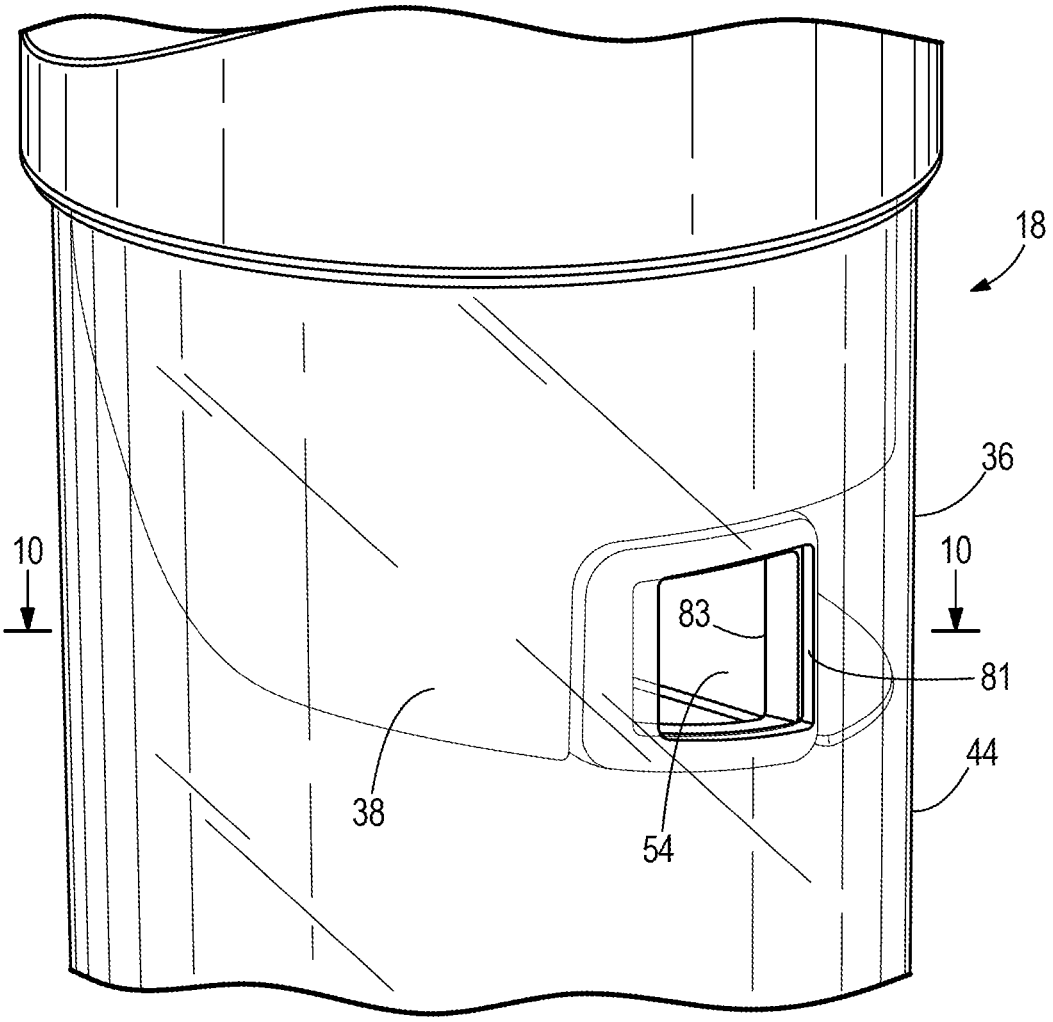
FIG. 9 is an enlarged view of the debris separator of the vacuum cleaner of FIG. 1.
Figure 10:
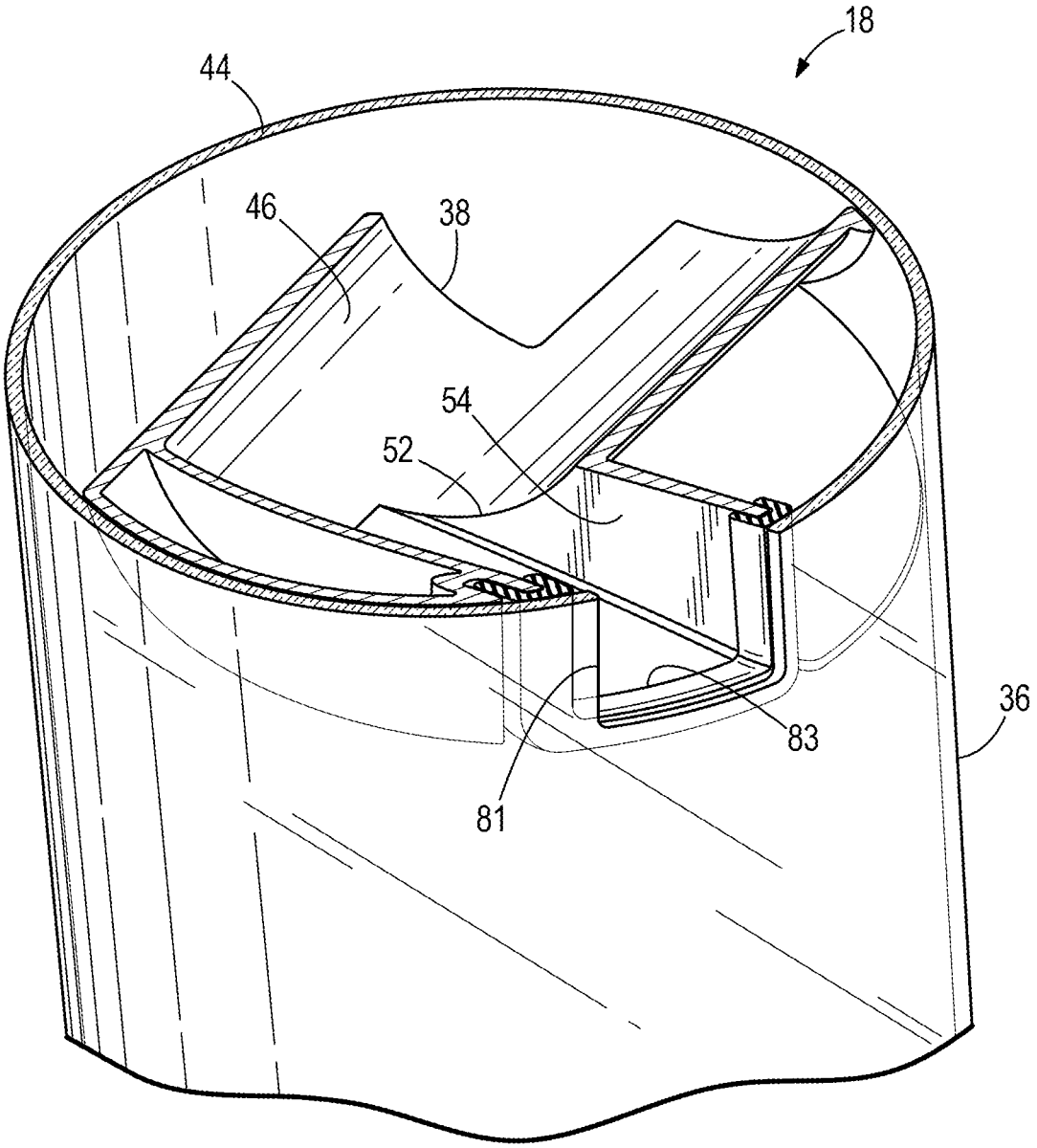
FIG. 10 is a cross-sectional view of the debris separator of FIG. 9 taken along lines 10-10 shown in FIG. 9.
Figure 11:
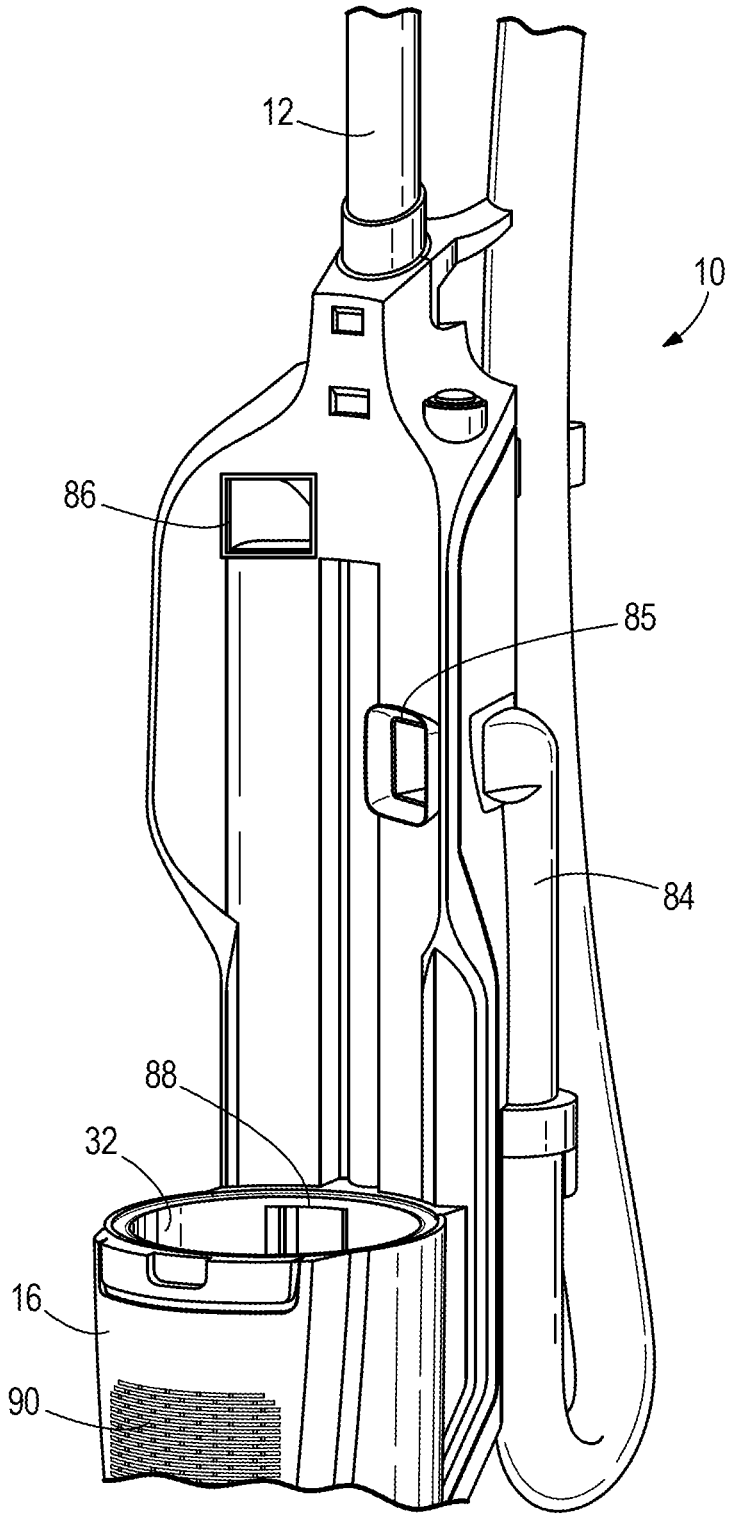
FIG. 11 is an alternative perspective view of the vacuum cleaner of FIG. 1 with the debris separator removed.

As best seen in FIGS. 9-11, the housing 36 includes an inlet aperture 81 through the housing wall 44 and the dirty air inlet 52 includes the passageway or duct 54 between the inlet aperture 81 and the cylindrical wall 46. The cyclonic separator 38 has a seal 83 positioned between the passageway 54 and the housing wall 44 around the inlet aperture 81 on an inside surface of the housing wall 44. The seal 83 may be attached to the cyclonic separator 38 removable from the housing 36 with the cyclonic separator 38, or the seal 83 may be attached to the housing wall 44. Additionally, the vacuum cleaner 10 includes a conduit 84 directing airflow from the suction nozzle 22 to the dirty air inlet 52, and the vacuum cleaner 10 has a seal 85 between the conduit 84 and the housing 36 around the inlet aperture 81 on an outside surface of the housing wall 44. In one embodiment, the seal 83 on the inside of the housing 36 to the cyclonic separator 38 and the seal 85 on the outside of the housing 36 to the conduit 84 is combined in one part attached to the housing 36.

Figure 8:
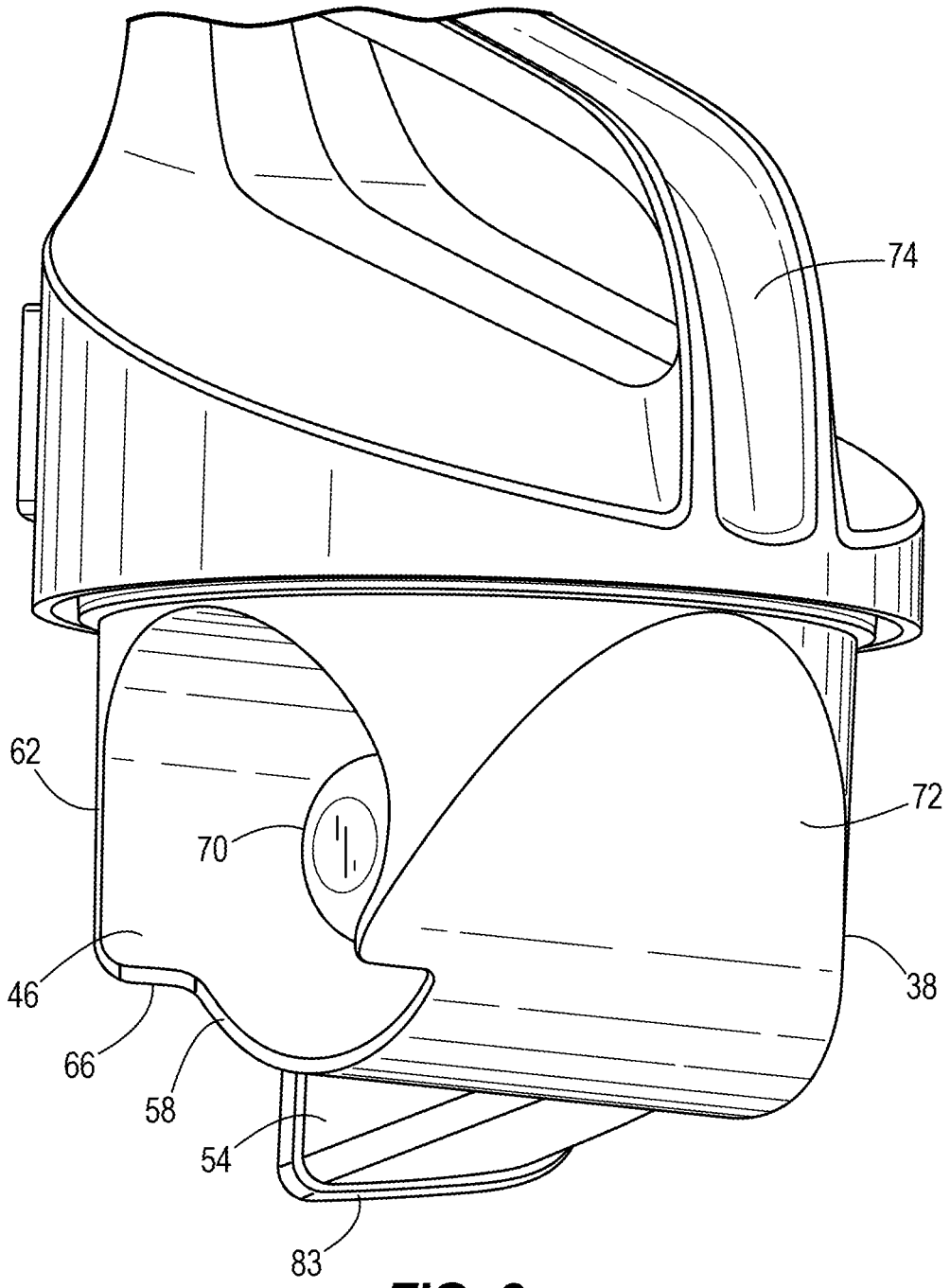
FIG. 8 is a perspective view of a lid and a cyclonic separator of the debris separator removed from the housing of the debris separator of the vacuum cleaner of FIG. 1.

The lid 74 is removably coupled to the upper end 40 of the housing 36 to enclose the upper end 40 of the housing 36. As illustrated in FIG. 8, the cyclonic separator 38 is coupled to the lid 74 so that the cyclonic separator 38 is removed from the housing 36 with the lid 74. Therefore, the user can easily clean the separator 38, if needed, by removing the lid 74 from the housing 36. As best seen in FIG. 1, the debris separator includes a latch 80, for example on the lid 74, that couples the debris separator 18 to the vacuum cleaner.

The door 78 (FIG. 1) is pivotally coupled to the lower end 42 of the housing 36. The door 78 can be opened to empty the debris collection chamber 76. As best shown in FIG. 5, the door 78 defines at least a portion of the suction source inlet chamber 32. As discussed above, a premotor filter can be located in the chamber 32. The user can access the filter for inspection, cleaning, and replacement by removing the debris separator 18 from the handle 12 to expose the filter.

Figure 3:
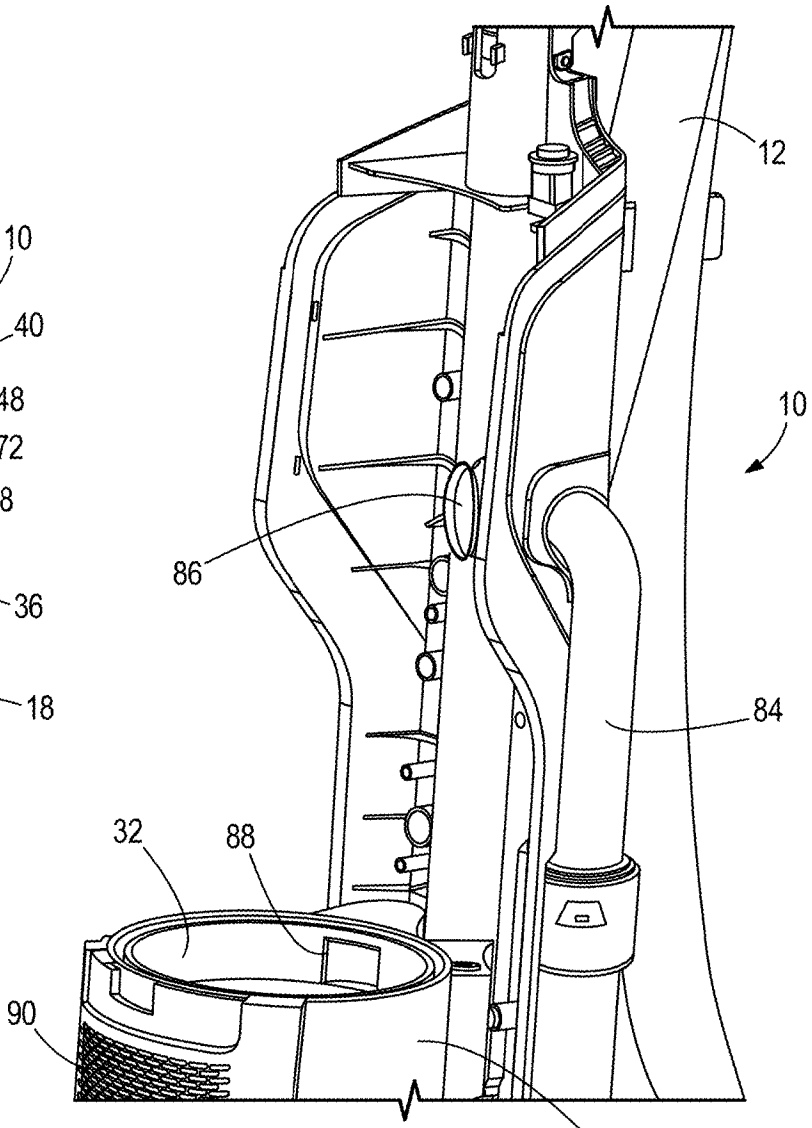
FIG. 3 is a perspective view of the vacuum cleaner of FIG. 1 with a debris separator removed.
Figure 2:
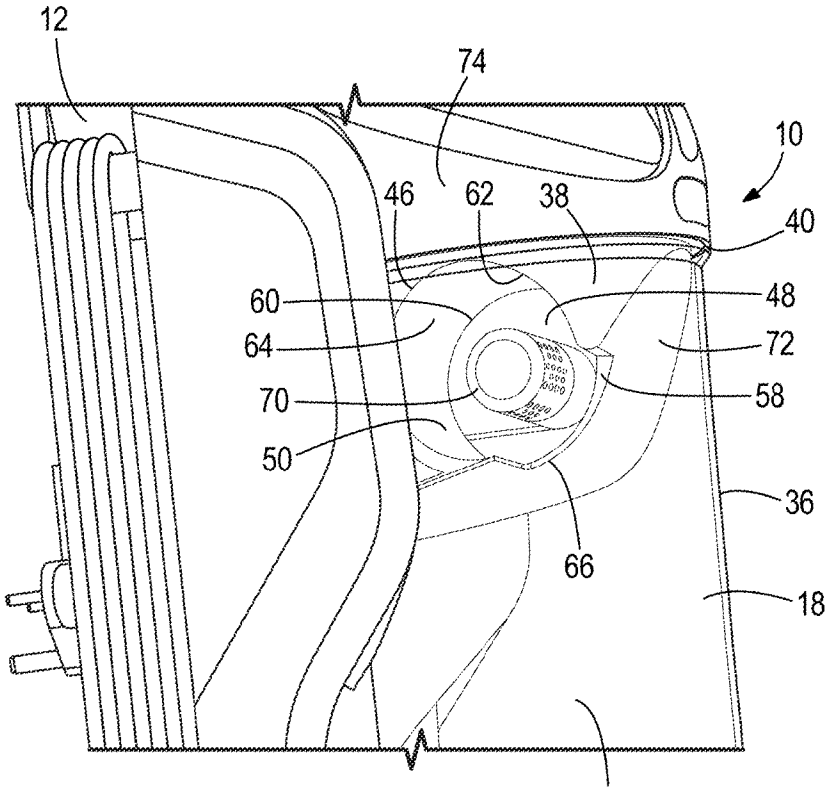
FIG. 2 is an enlarged perspective view of the vacuum cleaner of FIG. 1.
Figure 4:
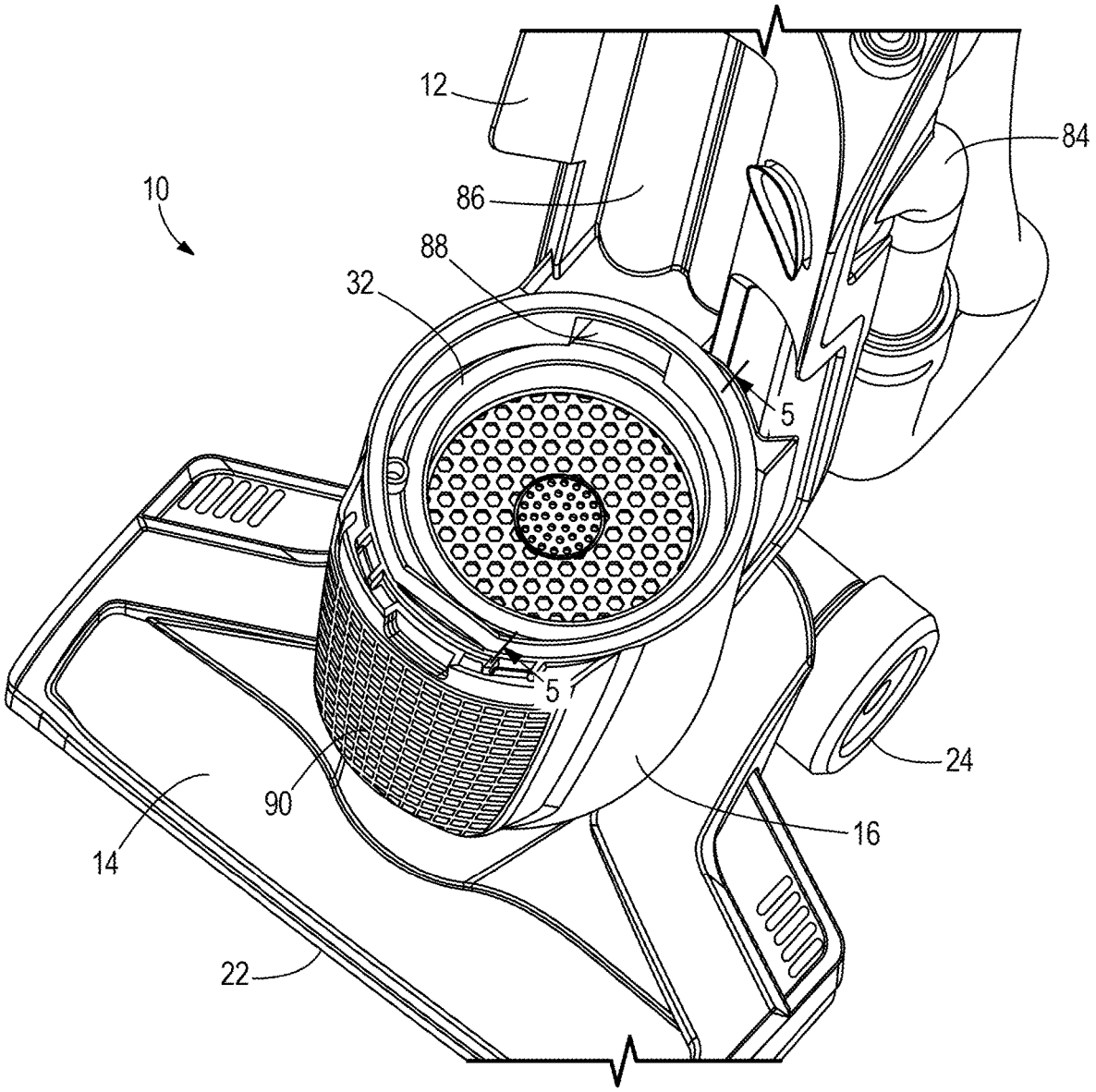
FIG. 4 is an alternative perspective view of the vacuum cleaner of FIG. 1 with the debris separator removed.

In operation, referring to FIG. 1, the suction source 16 generates an airflow that draws debris and the airflow through the suction nozzle 22. The airflow and entrained debris travel through a conduit 84 (FIG. 3) to the dirty air inlet duct 54 (FIGS. 6-8) of the cyclonic separator 38. The airflow and debris then travel through the dirty air inlet 52 and into to the cylindrical wall 46. The airflow and debris are rotated about the longitudinal axis 68 of the separator 38, which causes the debris to separate from the airflow. The debris is discharged over the cylindrical wall 46 through the debris outlet 58 and into the debris collection chamber 76. The clean airflow then travels through the perforated tube 70 and exist the cyclonic separator 38 through the clean air outlet 56. The clean airflow then travels through conduit 86 (FIG. 3) and out aperture 88 into the suction source inlet chamber 32. The premotor filter then further filters the clean airflow and the clean airflow travels through the suction source 16 before being discharged from the vacuum cleaner 10 through the clean air exhaust 90.

Various features and advantages of the invention are set forth in the following claims.

What is claimed is:

1. A vacuum cleaner comprising:

a suction nozzle;

a suction source operable to generate an airflow through the vacuum cleaner from the suction nozzle through a debris separator to a clean air exhaust;

the debris separator operable to separate debris from the airflow, the debris separator including, a housing including an first end, a second end, and a sidewall that is generally cylindrical, the generally cylindrical sidewall extends from the second end to the first end, the first end of the housing defining an open top surface, a cyclonic separator positioned within the housing, the cyclonic separator including a cylindrical wall having a first end and a second end, the cylindrical wall located in within the generally cylindrical sidewall of the housing, the cyclonic separator further including a first end wall located at the first end of the cylindrical wall, an dirty air inlet, a clean air outlet that extends through the first end wall, a debris outlet adjacent the second end, a longitudinal axis surrounded by the cylindrical wall and the longitudinal axis of the cyclonic separator extends in generally a horizontal orientation and through the generally cylindrical sidewall of the housing, a debris collection chamber located within the housing and in fluid communication with the debris outlet of the cyclonic separator, the debris collection chamber including an outer perimeter that is defined by the generally cylindrical sidewall of the housing, and a lid coupled to the open top surface, the cyclonic separator coupled to the lid;

wherein the lid couples to the open top surface such that the cylindrical wall of the cyclonic separator is between the open top surface and the second end of the housing, wherein the generally cylindrical sidewall of the housing forms a second end wall of the cyclonic separator located at the second end of the cylindrical wall of the cyclonic separator between the open top surface and the second end of the housing.

2. The vacuum cleaner of claim 1, wherein the generally cylindrical sidewall of the housing defines a portion of the debris outlet of the cyclonic separator.

3. The vacuum cleaner of claim 1, wherein the dirty air inlet is adjacent the first end of the cylindrical wall and extends through the generally cylindrical sidewall of the housing between the first end and the second end.

4. The vacuum cleaner of claim 1, further comprising a divider wall that extends from the cylindrical wall of the cyclonic separator to the generally cylindrical sidewall of the housing such that the sidewall of the housing and the divider wall define the debris collection chamber.

5. The vacuum cleaner of claim 4, wherein the divider wall and the cylindrical wall are integrally formed as a single unitary component.

6. The vacuum cleaner of claim 4, wherein the cyclonic separator further includes a dirty air inlet duct, wherein the divider wall at least partially defines the dirty air inlet duct.

7. The vacuum cleaner of claim 4, wherein the sidewall of the housing includes an inner periphery, and wherein the divider wall extends around the inner periphery of the sidewall.

8. The vacuum cleaner of claim 1, wherein the cyclonic separator is positioned entirely below the first end of the housing.

9. A vacuum cleaner comprising:

a suction nozzle;

a suction source operable to generate an airflow through the vacuum cleaner from the suction nozzle through a debris separator to a clean air exhaust;

the debris separator operable to separate debris from the airflow, the debris separator including, a housing including an upper end, a lower end, and a sidewall that is generally cylindrical, the generally cylindrical sidewall extends from the lower end to the upper end, the upper end of the housing defining an open top surface, a cyclonic separator positioned within the housing, the cyclonic separator including a cylindrical wall having a first end and a second end, the cylindrical wall located in within the generally cylindrical sidewall of the housing, the cyclonic separator further including a dirty air inlet, a clean air outlet, a debris outlet adjacent the second end, and a longitudinal axis surrounded by the cylindrical wall and the longitudinal axis of the cyclonic separator extends in a generally horizontal orientation, a lid coupled to the housing, the cyclonic separator coupled to the lid such that the cyclonic separator is removable from the open top surface of the housing with the lid and the cylindrical wall of the cyclonic separator is between the upper end and the lower end of the housing when the lid is attached to the housing adjacent the upper end of the housing, and a debris collection chamber located within the housing and in fluid communication with the debris outlet of the cyclonic separator, the debris collection chamber including an outer perimeter that is defined by the generally cylindrical sidewall of the housing.

10. The vacuum cleaner of claim 9, further comprising a divider wall that extends from the cylindrical wall of the cyclonic separator to the generally cylindrical sidewall of the housing such that the sidewall of the housing and the divider wall define the debris collection chamber.

11. The vacuum cleaner of claim 10, wherein the debris separator includes a latch that removable couples the debris separator to the vacuum cleaner.

12. The vacuum cleaner of claim 9, wherein the debris separator further includes a door pivotally coupled to the housing adjacent the lower end to facilitate emptying debris from the debris collection chamber.

13. The vacuum cleaner of claim 12, further comprising a suction source inlet chamber between the clean air outlet of the cyclonic separator and the suction source and a filter located in the suction source inlet chamber, wherein the suction source inlet chamber is at least partially defined by the door of the debris separator.

14. The vacuum cleaner of claim 9, wherein the cyclonic separator further includes a first end wall located at the first end of the cylindrical wall, and wherein the clean air outlet extends through the first end wall of the cyclonic separator.

15. The vacuum cleaner of claim 14, wherein the generally cylindrical sidewall of the housing forms a second end wall of the cyclonic separator located at the second end of the cylindrical wall.

16. The vacuum cleaner of claim 15, wherein the housing defines a portion of the debris outlet of the cyclonic separator.

17. The vacuum cleaner of claim 15, further comprising a divider wall that extends from the cylindrical wall of the cyclonic separator to the sidewall of the housing such that the sidewall of the housing and the divider wall define the debris collection chamber.

18. The vacuum cleaner of claim 17, wherein the sidewall of the housing is generally cylindrical having an inner periphery, and wherein the divider wall extends around the inner periphery of the sidewall.

19. The vacuum cleaner of claim 18, where the divider wall further comprises a portion extending along the inner periphery toward the lid encircling at least a portion of the cylindrical wall.

20. The vacuum cleaner of claim 17, wherein the divider wall and the cylindrical wall are integrally formed as a single unitary component.

21. The vacuum cleaner of claim 15, wherein the cyclonic separator further includes a dirty air inlet duct, wherein a divider wall at least partially defines the dirty air inlet duct.

22. The vacuum cleaner of claim 9, wherein the dirty air inlet is adjacent the first end of the cylindrical wall.

23. The vacuum cleaner of claim 22, wherein the housing includes an inlet aperture through the generally cylindrical sidewall of the housing and the dirty air inlet includes a passageway between the inlet aperture and the cylindrical wall, the cyclonic separator including a first seal between the passageway and the housing around the inlet aperture on an inside surface of the housing.

24. The vacuum cleaner of claim 23, wherein the vacuum cleaner includes a conduit directing airflow from the suction nozzle to the dirty air inlet, the vacuum cleaner including a second seal between the conduit and the housing around the inlet aperture on an outside surface of the housing.

25. The vacuum cleaner of claim 9, further comprising a perforated tube located within the cylindrical wall forming the clean air outlet, and wherein the perforated tube is removable from the housing with the lid.

26. The vacuum cleaner of claim 9, wherein the cyclonic separator is positioned entirely below an upper end of the housing.

* * * * *